US012644654B2

(12) United States Patent
Neuberger et al.

(10) Patent No.: US 12,644,654 B2
(45) Date of Patent: Jun. 2, 2026

(54) METHOD FOR PRODUCING PIPES HAVING TOPOGRAPHIC INNER STRUCTURES

(71) Applicant: Karlsruher Institut fuer Technologie, Karlsruhe (DE)

(72) Inventors: Heiko Neuberger, Linkenheim (DE); Frederik Arbeiter, Karlsruhe (DE); Sebastian Ruck, Karlsruhe (DE)

(73) Assignee: KARLSRUHER INSTITUT FUER TECHNOLOGIE, Karlsruhe (DE)

( * ) Notice: Subject to any disclaimer, the term of this patent is extended or adjusted under 35 U.S.C. 154(b) by 324 days.

(21) Appl. No.: 18/549,925

(22) PCT Filed: Mar. 15, 2022

(86) PCT No.: PCT/EP2022/056668
§ 371 (c)(1),
(2) Date: Sep. 11, 2023

(87) PCT Pub. No.: WO2022/194851
PCT Pub. Date: Sep. 22, 2022

(65) Prior Publication Data

US 2024/0175644 A1 May 30, 2024

(30) Foreign Application Priority Data

Mar. 16, 2021 (DE) ..... 10 2021 106 305.1

(51) Int. Cl.
*F28F 1/40* (2006.01)
*F28F 13/18* (2006.01)

(52) U.S. Cl.
CPC ..... *F28F 1/40* (2013.01); *F28F 13/18* (2013.01); *F28F 2255/00* (2013.01)

(58) Field of Classification Search
CPC ..... B23K 9/0253; B23K 11/062; B23K 11/0973; B23K 13/025; B23K 26/262;
(Continued)

(56) References Cited

U.S. PATENT DOCUMENTS 1,793,218 A * 2/1931 Free ..... B23K 11/0873 219/67
2,151,540 A * 3/1939 Varga ..... F28F 3/02 165/170
(Continued)

FOREIGN PATENT DOCUMENTS

CA 2193933 A1 6/1997
CN 106794561 A 5/2017
(Continued)

*Primary Examiner* — Jason L Vaughan
(74) *Attorney, Agent, or Firm* — LEYDIG, VOIT & MAYER, LTD.

(57) ABSTRACT

A method for producing a pipe with an inner pipe having topographic structures arranged on an inside of the inner pipe and having a coating arranged on an outside of the inner pipe, the method including: a) providing at least two pipe shell segments, each with an inner wall, an outer wall, and a peripheral abutment surface, which are placeable on one another in an accurately fitting manner to form the inner pipe; b) mounting or introducing the topographic structures on or in the inner wall of each pipe shell segment of the at least two pipe shell segments; c) placing the pipe shell segments on one another via the abutment surfaces to form the inner pipe so as to form abutment lines; d) fixing the pipe shell segments incorporated in the inner pipe by placing fixing means thereon; and e) additively applying a coating.

13 Claims, 11 Drawing Sheets

(58) Field of Classification Search
CPC ..... B23K 31/027; B23K 2101/08; B23K 2101/06; Y10T 29/49384; F28F 1/40
See application file for complete search history.

(56) References Cited

U.S. PATENT DOCUMENTS 2,473,633 A * 6/1949 Brown, Jr. ..... B23K 11/0046 219/107
2,647,981 A * 8/1953 Wogerbauer ..... B23K 13/02 219/67
4,753,849 A * 6/1988 Zohler ..... F28F 13/187 165/907
4,766,751 A * 8/1988 Ueda ..... B21D 11/14 72/181
4,890,669 A * 1/1990 Zohler ..... B23P 15/26 62/527
5,784,776 A * 7/1998 Saito ..... F28F 3/04 29/727
6,289,585 B1 * 9/2001 Staruszkiewicz ..... F28F 9/0243 165/173
6,412,549 B1 * 7/2002 Itoh ..... F28F 1/40 165/184
6,883,597 B2 * 4/2005 Thors ..... F28F 1/40 165/184
7,107,680 B2 * 9/2006 Ueda ..... F28D 1/0316 228/183
8,191,258 B2 * 6/2012 Zobel ..... F28D 1/0391 29/890.038
8,683,690 B2 * 4/2014 Zobel ..... B21C 37/151 165/177
11,285,522 B2 * 3/2022 Nakaura ..... F28F 19/06
11,465,194 B2 * 10/2022 Shih ..... B21D 51/04
11,534,857 B2 12/2022 Sochi
2024/0035754 A1 * 2/2024 Tong ..... F28F 1/40

FOREIGN PATENT DOCUMENTS

DE 2227955 A1 1/1974
JP S59164889 A 9/1984
JP 6836887 B2 3/2021

* cited by examiner

DETAIL B

METHOD FOR PRODUCING PIPES HAVING TOPOGRAPHIC INNER STRUCTURES

CROSS-REFERENCE TO PRIOR APPLICATIONS

This application is a U.S. National Phase application under 35 U.S.C. § 371 of International Application No. PCT/EP2022/056668, filed on Mar. 15, 2022, and claims benefit to German Patent Application No. DE 10 2021 106 305.1, filed on Mar. 16, 2021. The International Application was published in German on Sep. 22, 2022 as WO 2022/194851 A1 under PCT Article 21(2).

FIELD

The invention relates to a method for producing a pipe, preferably made of metal, more preferably a heat exchange pipe or pipe element, with topographic structures arranged on the inner wall, and to a pipe, respectively.

BACKGROUND

The pipes mentioned at the outset are generally made of metal. They serve, in particular, for the passage of fluids such as, for example, liquids and/or gases, but also suspensions, emulsions, aerosols or liquid mixtures (hereinafter also referred to as working fluid) through a heat exchanger, a combustion chamber, a flue gas outlet or another device or medium that receives or discharges heat. Usually, the pipe walls of the pipes form, at least in portions, the heat exchange surfaces of the heat exchanger, it being basically endeavored to design the surfaces to form a good heat connection to the respective adjacent medium such as the aforementioned fluid. For this purpose, cooling ribs or fluid-conducting elements which are attached or molded to the outer surfaces are provided on the outer surfaces in order to aim for the greatest possible flow through a heat transfer medium or coupling of radiant heat. In the interior, conventional cylindrical pipes are, by contrast, usually smooth or unstructured, in particular as a result of the manufacturing process in the case of small inner diameters of the pipe. It is also generally known that, for a better thermal coupling of the heat exchange surfaces to the fluid passed through, their specific contact surface is increased. For example, this is usually implemented by a branching of the flow cross section to multiple individual pipes having a smaller diameter.

On the other hand, pipes with structured inner wall surfaces are known. For example, encircling geometric structures similar to the profile of the inner side of a gun barrel are used in the refrigeration/air-conditioning industry. Rifled pipes are used in heat exchangers of power plants; they also have an uneven inner surface. The structuring serves to influence the turbulence-increasing influence on the flow through the pipe in such a way that the insulating flow boundary layer is reduced on the inner wall surfaces.

The use of surface structures such as, for example, ribs, dimples and pins on heat exchanger surfaces leads to an increased heat transfer between the working fluid and the component wall and is a proven method to realize high heat flow densities and high working fluid temperatures while maintaining component-specific maximum temperatures in thermally highly loaded components. Depending on the type of thermal boundary conditions present at the heat-discharging or -absorbing wall, an improved heat transfer leads to a reduction in the component material temperature or enables faster increase in the adiabatic mixing temperature of the working fluid in the main flow direction. Thus, the component service life can be extended, the thermal plant efficiency can be increases, the heat transfer surfaces can be reduced, or a higher load flexibility of the component can be realized.

In spite of additional pressure and frictional losses (with the same mass flow of the working fluid in channels with structured surfaces, the ratio of heat transfer to required pump power can be increased. Here, the configuration of the surface structures plays a decisive role in particular. Rib structures are distinguished by very high heat transfer compared to other surface structures. Rib structures are already used in solar receivers, in gas-cooled reactor components, or in air-cooled gas turbine blades of conventional gas power plants. In this case, the components through which flow flows are produced as cast parts from single-use molds or as a welded construction consisting of several components; additive manufacturing methods are also increasingly used.

Furthermore, Ruck S., Arbeiter F.: Thermal Performance Augmentation by Rib Arrays for Helium-gascooled First Wall Applications; Fusion Engineering and Design 124 (2017) p. 306-310, describe rib structures for improved heat transfer in a channel which is closed after application. The special feature of the so-called Semi-detached V-Ribs is that they are fixedly connected to the channel wall only at one point (e.g., in the center of the rib). Between the ribs and the channel wall there is a gap with a height of, for example, 0.1 mm, which, when a fluid is passed through the channel, is also passed through by the fluid. The effect of the previously used pipe inner structures can thereby be further increased by achieving a large-scale mixing beyond the boundary layer at the pipe wall.

A manufacturing-related implementation of complex structured surfaces (in particular rib structures such as Semi-detached V-Ribs, locally changing structures, e.g., from dimples to ribs or any combination thereof) within pipelines of the aforementioned kind requires the accessibility of the pipe inner wall, for example with a tool for mechanical or electrochemical machining, a focused energy beam (laser structuring) or a device (for example for positioning and joining of, for example, flow-guiding plates).

However, an internal machining of aforementioned pipes is increasingly complicated with increasing pipe length and with decreasing pipe diameter, if not no longer feasible with reasonable effort from a certain point. The accessibility for machining the pipe inner surface is essential, and is increasingly more difficult with decreasing pipe diameter (typical order of magnitude, for example, in pipe bundle heat exchangers in the range of a few cm).

SUMMARY

In an embodiment, the present invention provides a method for producing a pipe with an inner pipe having topographic structures arranged on an inside of the inner pipe and having a coating arranged on an outside of the inner pipe, the method comprising: a) providing at least two pipe shell segments, each with an inner wall, an outer wall, and a peripheral abutment surface, which are placeable on one another in an accurately fitting manner to form the inner pipe; b) mounting or introducing the topographic structures on or in the inner wall of each pipe shell segment of the at least two pipe shell segments; c) placing the pipe shell segments on one another via the abutment surfaces to form the inner pipe so as to form abutment lines; d) fixing the pipe shell segments incorporated in the inner pipe by placing fixing means thereon; and e) additively applying a coating comprising a metallic material to an outer wall of the pipe shell segments over the abutment lines to form a contiguous pipe body.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
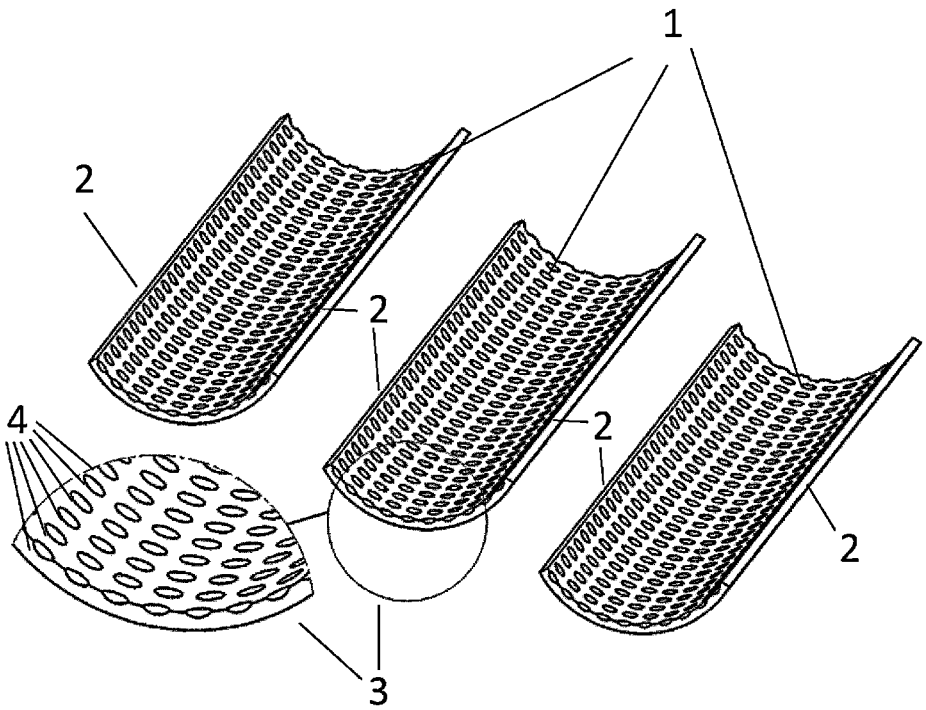
FIG. 1*a* to 1*i* show schematic illustrations of the method and the pipe of a first exemplary embodiment with perspective views of the intermediate products.

In an embodiment, the present invention provides a method for producing pipes with, in particular, complex inner structures, said method not having the aforementioned limitations in its practicability.

In an embodiment, the present invention provides a pipe, in particular a heat exchange pipe, with internal structures, preferably produced by the aforementioned method.

In an embodiment, the present invention provides a multilayer structure of the pipe. In this case, the inner pipe is preferably completely composed of multiple, preferably two or three, separate pipe shell segments, wherein said pipe shell segments are in contact and alignment with one another at their abutment surfaces and thus form abutment lines. The inner structures are mounted beforehand on the inner surfaces of the pipe shell segments, the pipe shell segments preferably already being present pre-shaped in the form of a near-net-shape during the mounting or introduction of the topographic structures on or in the inner wall, such that they can be placed against each other at the abutment surfaces without further deformation to form the inner pipe.

By dividing the inner pipe into separate pipe shell segments, the inner wall is better accessible for introducing a structuring. As a result of their preferred near-net-shape pre-deformation, a further deformation of the structured inner wall and thus a possible loading, deformation or damage to the structures up to integration into the inner pipe is avoided or at least significantly reduced. This particularly counteracts a realization of filigree and/or composite structures. The pipe shell segments are preferably formed by trough-shaped segments, and multiple these segments, arranged axially parallel to one another, can be assembled together to form the inner pipe or an inner pipe portion. Alternatively or additionally, the pipe shell segments can be formed by short annular inner pipe portions, which then, arranged axially in series with respect to one another, are assembled together to form the inner pipe or an inner pipe portion.

This inner pipe formed by the pipe shell segments is coated, after the assembly, from the outside on the outer wall of the pipe shell segments with a second layer, a coating consisting of a metallic material, across the abutment lines and abutment surfaces of the pipe shell segments, wherein a contiguous pipe body is produced and this is closed over the abutment surfaces despite possible gaps, manufacturing tolerances or misalignments. The coating is carried out by means of additive application, for avoiding production-related stress states and for reducing thermally related degradation of the inner structures, preferably at temperatures below 500° C., more preferably below 350° C. Gaps and error sources are filled and compensated for by the coating.

The periphery of the inner pipe always extends in each axial position of the inner pipe cross section preferably via at least two pipe shell segments. Likewise, an embodiment within the scope of the invention is provided in which the pipe is also axially divided into multiple pipe shell segments, wherein the abutment surfaces between these pipe shell segments are arranged axially and/or in the peripheral direction preferably offset to one another. Accordingly, the abutment lines on the inner pipe are oriented axially and/or in the peripheral direction, wherein the abutment lines are not necessarily oriented in a straight line.

The solution to the problem consequently comprises a method for producing a pipe having an inner pipe having topographic structures arranged on the inside and having a coating arranged on the outside, comprising the following method steps:

In a first step, providing at least two pipe shell segments of the aforementioned type, each having an inner wall and an outer wall, which can be placed on one another in an accurately fitting manner to form the inner pipe. The inner pipe is then preferably formed only by the assembled pipe shell segments.

The shell segments are preferably produced by means of primary forming, re-shaping, removal or cutting methods.

In the case of primary forming, the pipe shell segments are already produced with Semi-detached Ribs or other structures, for example by means of injection molding. The primary forming is advantageous in particular in the case of large numbers, wherein in individual cases a method-related limitation must be accepted in the material selection.

In the case of cutting/re-shaping, the pipe shell segments are preferably punched out of sheet metal coils and re-shaped accordingly. Simple surface structures can be embossed here, as necessary. However, the possibility in the production of elements, such as ribs or baffle plates, which are attached at specific points, are limited and optionally require further method steps, for example by means of joining.

Laser jet, plasma jet or water jet quenching can also be used to produce shell segments, particularly if seamless pipes are used as semi-finished products for shell or ring segments. Here too, the options for the direct introduction of ribs or baffle plates are limited and optionally require further method steps.

If they have not already been integrated in method step a) as a result of the manufacturing process, the topographic structures are mounted or introduced on or in the inner wall of the pipe shell segments. This is preferably done by means of joining, removal or coating methods.

In the case of joining, for example, the aforementioned rib structures are joined at specific points, preferably welded or riveted (joining by re-shaping).

A removal method comprises a cutting or non-cutting method which can be used for incorporation of structures into the inner wall. For example, inner structures can be formed on the pipe shell segments by erosion, laser structuring, milling, etc. However, removal methods are less suitable for the production of the Semi-detached Ribs.

The pipe shell segments are put together via their abutment surfaces to form the inner pipe, with formation of the aforementioned abutment lines. In this case, the pipe shell segments preferably form the entire inner pipe, with their edges, i.e., their abutment surfaces, preferably resting on each other without overlap and forming the abutment lines. Within the scope of a preferred embodiment, the pipe shell segments bear form-fittingly against one another like puzzle parts that fit together, which in turn requires a corresponding geometric configuration of the pipe shell elements in their edge regions and thus abutment surfaces. Within the scope of a preferred alternative embodiment, the abutment surfaces between two pipe shell elements have form-fitting guide elements or overlapping regions to adjacent abutment surfaces and in this way bring about a form-fitting joining of the pipe shell elements to one another.

This is followed by a fixing of the pipe shell segments integrated in the inner pipe by attachment of fixing means, preferably clamps encircling the inner pipe. The fixing preferably takes place at least in each case at the end regions of the pipe and/or in the case of an axially serial arrangement of multiple pipe shell segments bridging the corresponding peripheral abutment lines. If the inner pipe is formed as pipe shell segments, as described above, by multiple short annular inner pipe portions arranged axially in series, or if an axial clamping of the pipe segments in the inner pipe is required, the fixing means required for this purpose comprises a tension rod guided through the inner pipe with receiving elements for the inner pipe ends.

Subsequently, an additive application of the coating consisting of a metallic material to the outer wall of the pipe shell segments over the abutment surfaces to form a contiguous pipe body is proposed. The additive application is preferably carried out by means of an application welding method, wherein the metallic material is provided in powder or wire form and is melted by a heat source, preferably an energy beam or an arc discharge. This results in a continuous coating on the inner pipe, which is further divided by the abutment lines, wherein the aforementioned energy beam and/or arc discharge is heated together with the abutment surfaces and, if necessary, a diffusion welding process starts. An alternative embodiment provides for an application of the coating by means of cold gas spraying or thermal spraying, wherein the metallic material is provided in powder form. Cold gas spraying is carried out in a particularly advantageous manner at temperatures below 400° C., more preferably below 300° C., i.e., at process temperatures which leave the pipe shell segments and the structures virtually uninfluenced.

Preferably, a method extension is proposed in particular when the fixing elements are attached via regions of the outer walls of the pipe shell segments and thus cover these regions. These covered regions on the outer wall of the pipe shell segments are not coated with the aforementioned additive application of the coating consisting of a metallic material. If these fixing elements are not incorporated in the coating and are also intended to remain, a subsequent post-processing is proposed, comprising the following method steps:

Removal of the fixing means, wherein the regions of the outer walls covered up to then are exposed.

Additive application of the metallic material in the aforementioned regions of the outer walls which are exposed upon removal of the fixing means, as part of the coating. This is preferably done using the same or similar metallic coating material and the same coating method.

The aforementioned coating on the inner pipe is preferably subsequently thermally and/or mechanically post-processed.

Thermal post-processing is used on the one hand to reduce the internal stresses in the coating, which is to be expected in particular in the case of coating methods at temperatures significantly below the melting temperature and significantly below the temperature (sintering temperature) of the metallic coating material required for a diffusion rearrangement (preferably less than 50% of the melting temperature in K, preferably less than 500° C., more preferably less than 350° C.), in particular in the case of cold gas spraying. The temperature control is preferably carried out at temperatures between the sintering temperature and the melting temperature of the metallic material.

A mechanical post-processing is used in particular to adjust a predeterminable external geometry of the lateral surface of the contiguous pipe body by material removal on the coating. Preferably, this post-processing comprises overmachining, preferably by overturning or overgrinding, of the coating, wherein a rotationally symmetrical coating surface arranged concentrically to the pipe is further produced.

A processed coating surface preferably has a smoother and more uniform surface compared to an unprocessed coating surface. Preferably, this is also arranged concentrically to the inner pipe, so that the coating has an approximately identical layer thickness above the outer surface of the inner pipe. By this alone, notch effects and stress singularities in the coating originating from the coating surface are already advantageously reduced.

Preferably, this mechanical machining is also provided by a thermal post-processing, preferably with known procedures and parameters of a stress-relief annealing or a further post-compaction of the coating which is subject to diffusion-rearrangement.

Alternatively or optionally, the aforementioned mechanically machined coating surface preferably also serves as a contact surface of a pressure-bearing structure which is subsequently pushed over and/or pressed onto the coating surface concentrically. Any excess pressures in the inner pipe are preferably predominantly mechanically absorbed by this structure, the slotted inner pipe arranged underneath and the coating advantageously relieved. The pressure-bearing structure is preferably a seamless pipe with an inner diameter greater than or equal to the outer diameter of the cylindrical coating surface.

Preferably, the pressure-bearing structure or the seamless pipe and the inner pipe and the coating end at least at one end face, preferably at both end faces, axially at the same position; they then further preferably form one or two common end face(s).

If the pressure-bearing structure, preferably a seamless pipe, is pushed over the coating surface, it is preferably proposed to weld the end faces thereof to the inner pipe preferably in a vacuum. A closed interior volume is produced between the inner pipe and the pressure-bearing structure or seamless pipe. By means of a preferably hot isostatic pressing of the seamless pipe with the coating surface, a diffusion-driven material rearrangement, such as, for example, a diffusion welding or a sintering, is started, which leads to a compression and/or material bonding between the coating surface and the inner surface of the pressure-bearing structure arranged above it.

The solution to the problem further comprises a pipe having an inner pipe with topographic structures arranged on the inside on the inner wall and having a coating placed on the inner pipe. In this case, the inner pipe is formed by at least two pipe shell segments, each having an inner wall and an outer wall, which are placed on one another in an accurately fitting manner with their preferably peripheral abutment surfaces and preferably without further deformation to form a pipe portion with the formation of abutment lines. Topographic structures are arranged on the inner walls of the pipe shell segments. The coating consists of a metallic material and is applied to the outer wall of the pipe shell segments over the abutment surfaces and forms an outwardly pointing coating surface. The pipe is preferably produced according to the aforementioned method. The pipe shell segments are preferably made here of a metal, more preferably of steel, an iron-based alloy or a nickel-based alloy. Nickel-based alloys are distinguished in particular by a pronounced corrosion resistance and increased temperature resistance, which is advantageous in particular when used in receivers.

The method for producing a pipe of a first exemplary embodiment as well as embodiments thereof are shown in FIG. 1*a* to *i*. The method steps are illustrated by means of intermediate products.

FIG. 1*a* represents the first method steps: the provision of at least two identical pipe shell segments 1 (three of which are shown), which are pre-bent in the end contour, each with an inner wall, an outer wall and a peripheral abutment surface 2, which can be placed on one another in an accurately fitting manner to form the inner pipe. Topographic structures 4 are mounted or introduced on or in the inner walls, emphasized by a schematic depiction in the detailed view 3. As shown, the topographic structures are distributed on the inner walls, i.e., in particular also arranged away from the abutment surfaces.

Figure 1B:
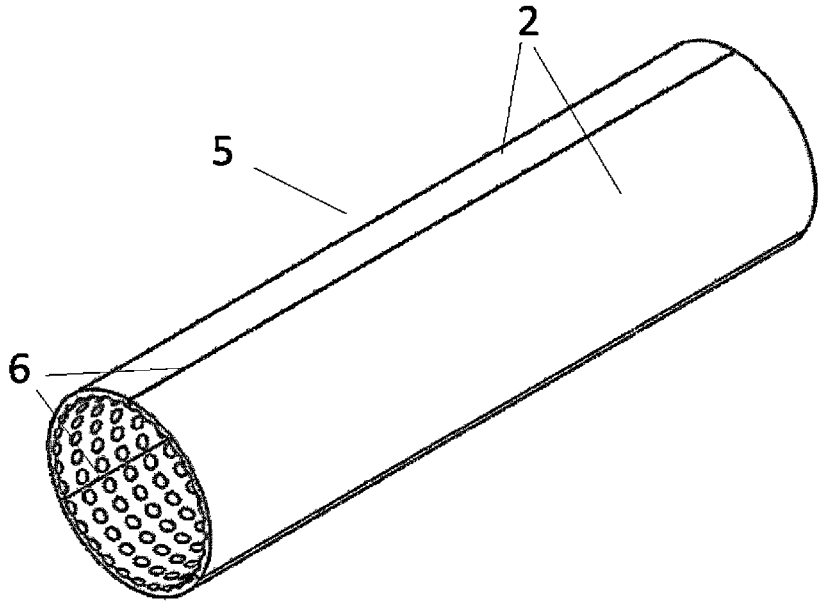
Figure 1C:
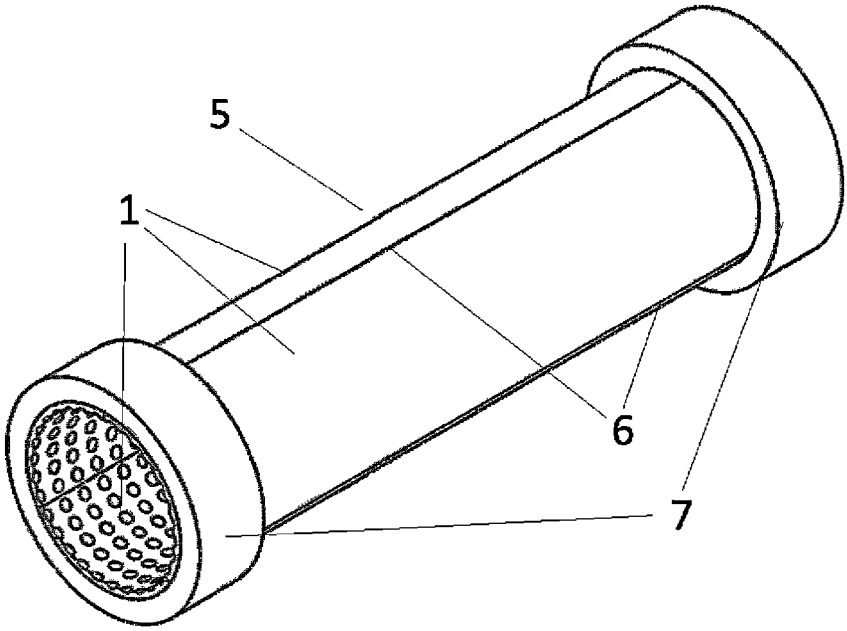

Subsequently, in a second method step, the aforementioned pipe shell segments 1 are assembled together via the abutment surfaces to form the inner pipe 5 with formation of abutment lines 6. FIG. 1*b* shows the assembled inner pipe, wherein the pipe shell segments incorporated in the inner pipe subsequently by attaching fixing means 7 are fixed in the example by clamps gripping around the inner pipe ends (FIG. 1*c*). As shown, the fixing means are preferably placed only externally on the inner pipe and do not form topographic structures on the inner walls.

Figure 1D:
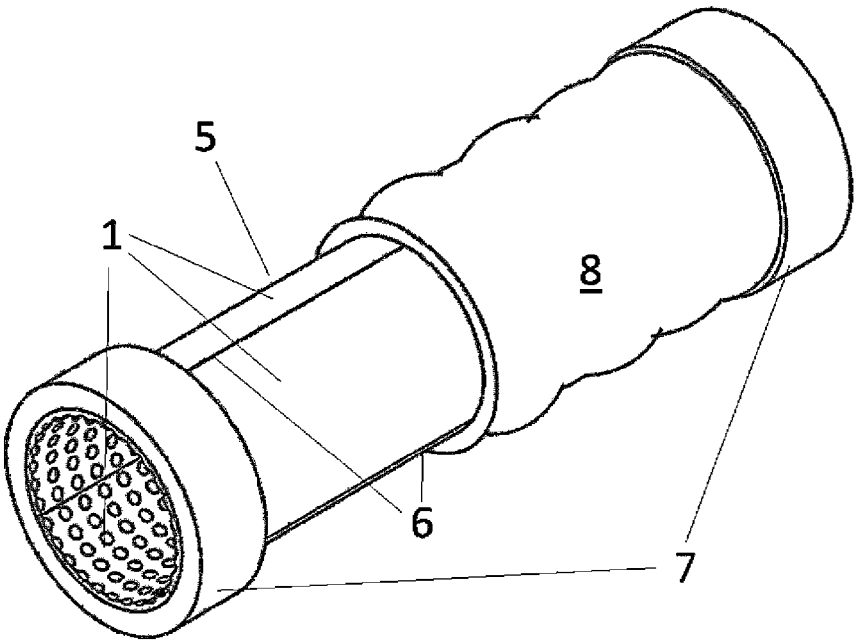

The connection between the individual pipe segments 1 is carried out by material application, in the example by additive application of the coating 8 consisting of a metallic material on the outer wall of the pipe shell segments 1 across the abutment lines 6 to form a contiguous pipe body. FIG. 1*d* represents this method step before its conclusion, i.e., with coating 8 applied only partially between the two fixing means 7 over the inner pipe 5 and bridging the abutment lines 6. As shown, the coating preferably does not cover the fixing means.

Figure 1E:
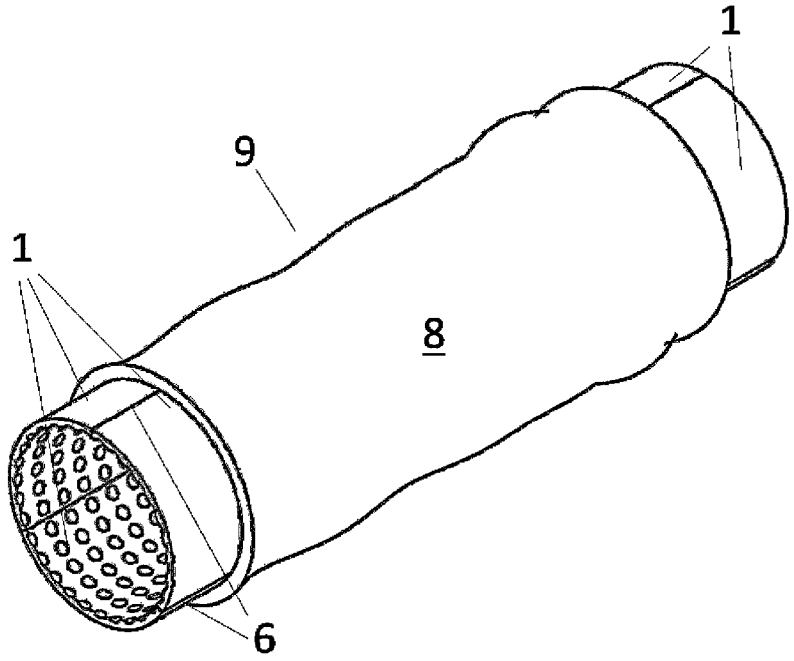

Between the inner pipe 5 and the fixing means 7, no coating portions are present, as can be seen in FIG. 1*e* after an optional decrease in the fixing means from the otherwise coated inner pipe. Solely by the removal of the fixing means are the regions of the outer walls, covered up to then, exposed. A contiguous pipe body 9 is formed from the inner pipe and the coating.

Figure 1F:
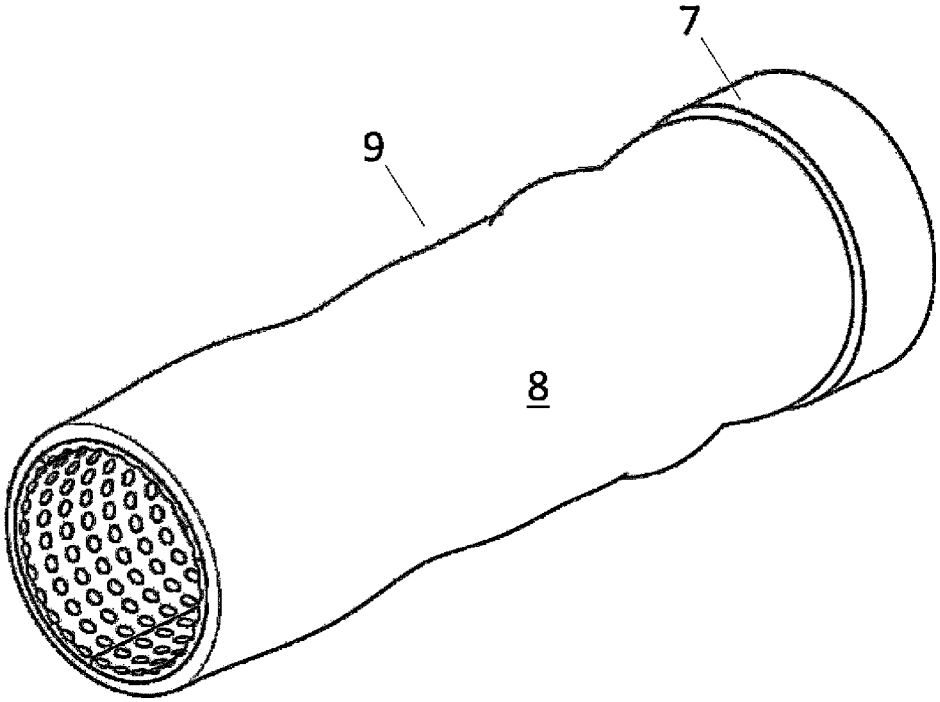

FIG. 1*f* shows an example of a pipe body 9 in which, at one end, the coating 8 at a pipe end extends over the outer wall of the inner pipe exposed by a removed fixing means. At the other end, a fixing means 7 is still arranged over the inner pipe to illustrate the position. In order to reduce the set-up process, however, it is preferably proposed that all fixing elements for a provided coating over the entire length of the pipe body be removed from the inner pipe at the same time—unless there are stability reasons to the contrary (cf. FIG. 1*e*).

Figure 1G:
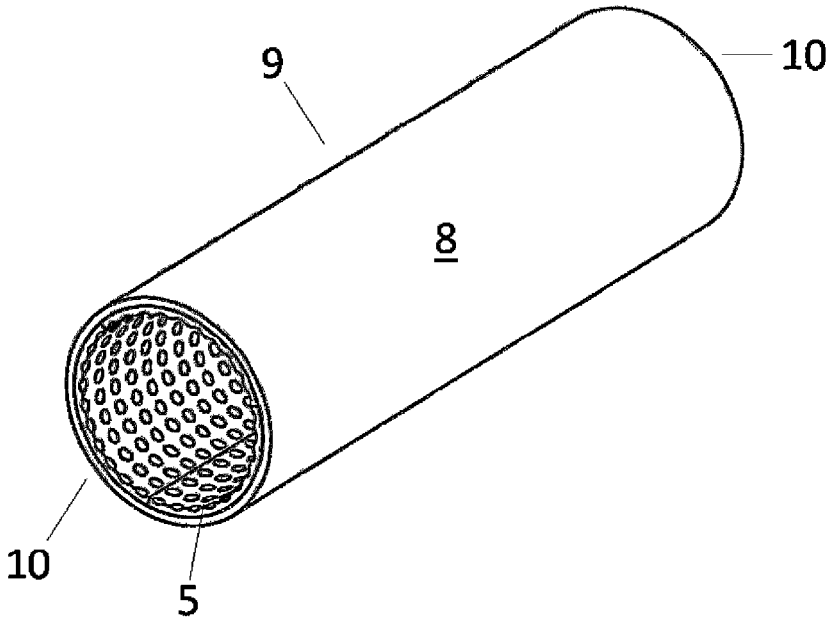

FIG. 1*g* represents subsequent preferred method steps in which the coating 8 extending over the entire length of the pipe body 9 and/or the end faces 10 of the inner pipe 5 with the coating 8 are subjected to a mechanical post-processing. The mechanical post-processing comprises or consists of an overmachining, preferably an overturning or overgrinding, which is further preferred. The objective is, on the one hand, to transfer the coating surface into a rotationally symmetrical shape arranged concentrically to the inner pipe, preferably with a uniform layer thickness or outer diameter, and, on the other hand, to uniformly cut to length the ends of the inner pipe and the coating with formation of an end face in each case.

Figure 1H:
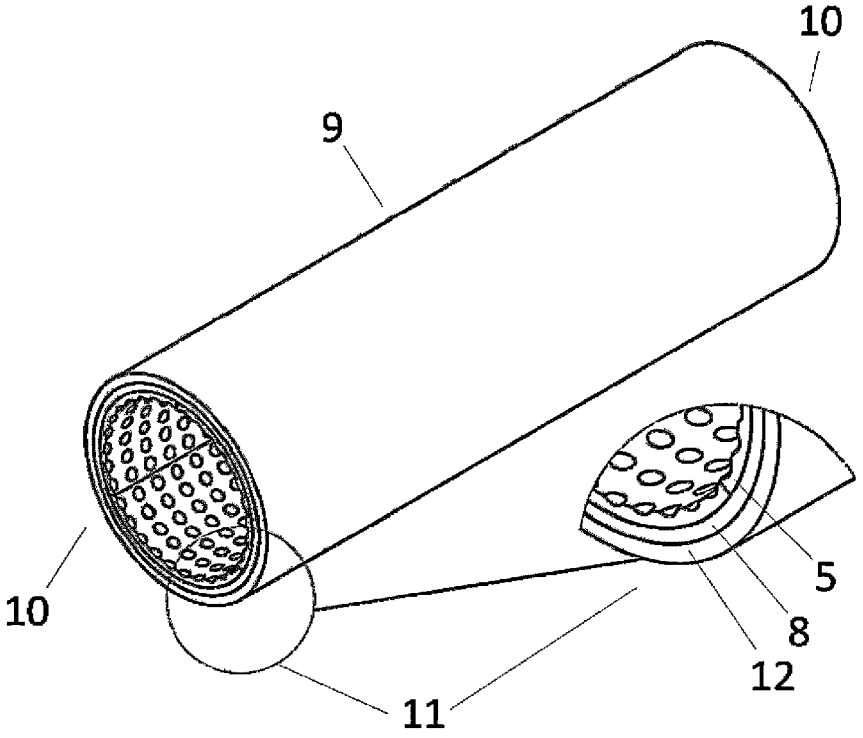

In an optional further method step, a concentric sliding over or pressing on (possibly shrink fitting with the use of thermal expansion effects) of a pressure-bearing structure takes place over the coating surface of the coating 8, wherein further preferably the pressure-bearing structure is a seamless pipe 12 with an inner diameter and the coating surface is cylindrical with a diameter smaller than or equal to the inner diameter (or, when shrink fitting is used to produce a press fit, may also be slightly larger) (cf. FIG. 1*h*). As shown in the detailed view 11, the inner pipe 5, coating 8 and seamless pipe 12 then lie concentrically one above the other and form a layer sequence.

Figure 1I:
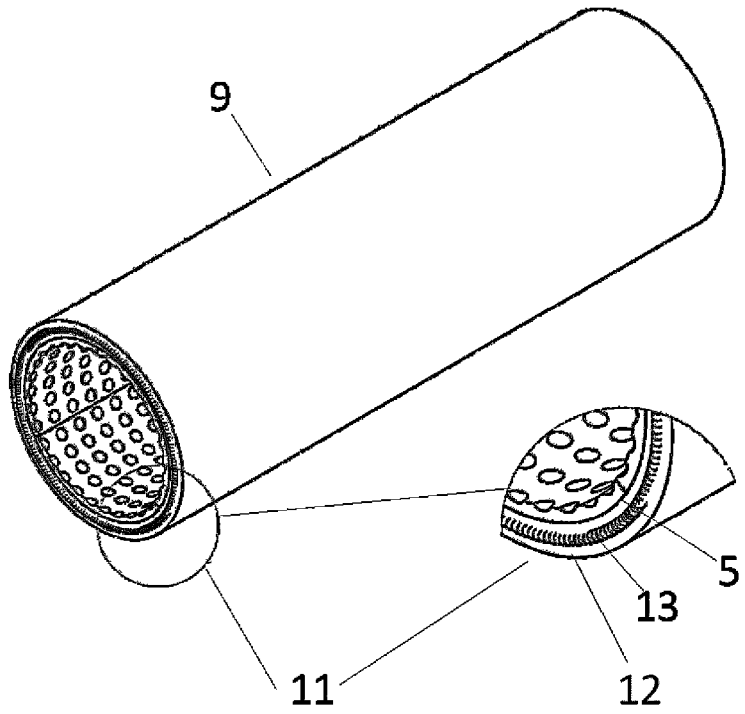

In a subsequent optional further step, this layer sequence is preferably integrally bonded to itself, wherein in a first sub-step an end-face welding of the seamless pipe with the coating surface is preferably proposed. A further welding at the opposite end face in a vacuum forms a closed interior volume with a vacuum therein (or a closed contact surface when shrink fitting is used). FIG. 1*i* shows, in a detailed view 11 of an end face, a weld seam 13 which runs in an encircling manner on the end face and that sealingly connects the inner pipe 5 to the seamless pipe 12 when the coating is bridged.

Hot isostatic pressing (HIP) of the seamless pipe with the coating surface follows, wherein the inner pipe and the seamless pipe are compressed by the applied pressure. The adjustable temperature is preferably between the sintering temperature and the melting temperature of the metallic material of the coating, preferably between 0.7 and 1.0 times the melting temperature. At this temperature, surface diffusion takes place, i.e., diffusion-driven material transport and thus further compaction in the coating. On the other hand, a material connection takes place by means of material rearrangement, in particular between the coating surface and the seamless pipe arranged thereabove.

Figure 2A:
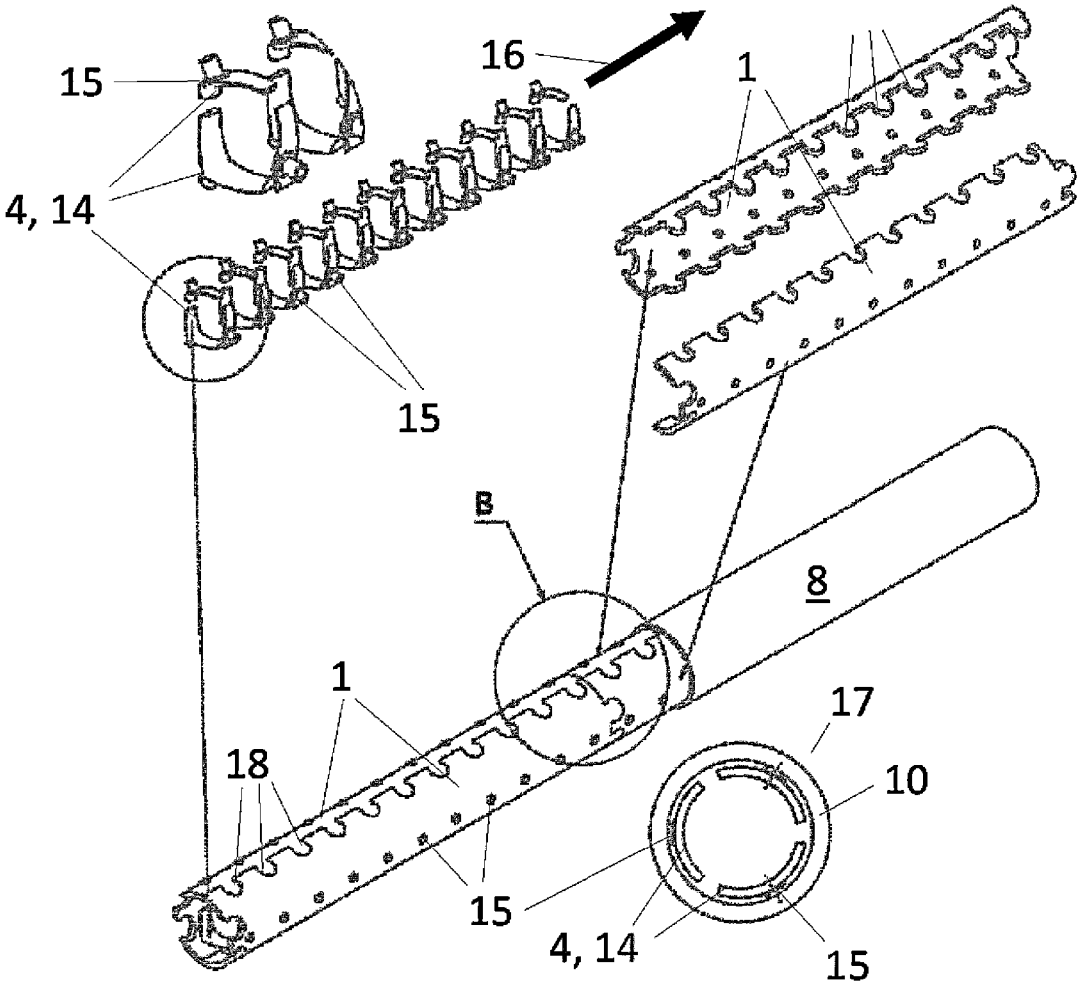
FIGS. 2*a* and 2*b* show schematic representations of a second exemplary embodiment with alternative embodiments of the pipe shell segments, the topographic structures and the fixing elements.
Figure 2B:
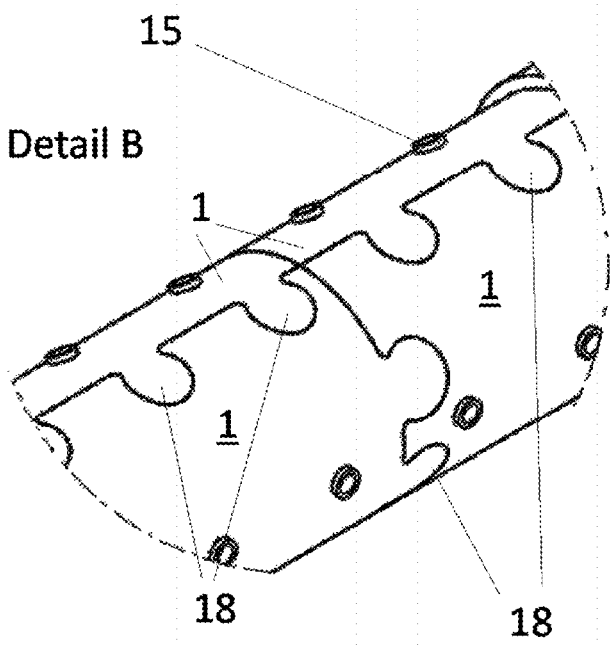

FIG. 2*a* and the detailed drawing FIG. 2*b* show an alternative preferred embodiment of the following details:

The topographic structures on the inner wall of the pipe shell segments are flow baffle plates 14 fitted on the inner wall which are positioned via peripherally arranged grooves 15 against stops arranged according to a later flow direction 16. These flow baffle plates advantageously provide a comparatively large specific surface area for heat transfer. In addition, they serve for flow guidance and stabilization of a fluid flow that can be passed through the inner pipe in the region of the inner wall, i.e., —as is particularly clearly recognizable in the cross-section 17 in FIG. 2*a*—especially in the regions close to the edge, in which preferably a heat-insulating flow boundary layer is formed.

If the abutment surfaces of the pipe shell segments 1 are formed as interlocking shaped elements 18, in a particularly advantageous manner, they enable the pipe shell segments to be assembled together as in a puzzle. Depending on the embodiment, they can also be used as fixing elements or at least as a design supporting the fixing elements. This embodiment is particularly advantageous also when the inner pipe is composed, as shown, of multiple pipe shell segments which are arranged both axially and in the peripheral direction, i.e., tangentially one behind the other.

The individual pipe shell segments can be positioned at least temporarily with the aforementioned shaped elements via a suitable device relative to one another via inner cone and outer cone, and can be fixed with defined pressure relative to one another in the axial direction during the material application with rotation about the main axis by means of cold gas spraying.

FIG. 3*a* to *e* show an alternative embodiment in which the pipe shell segments 1 are formed by annular inner pipe portions 19.

Figure 3A:
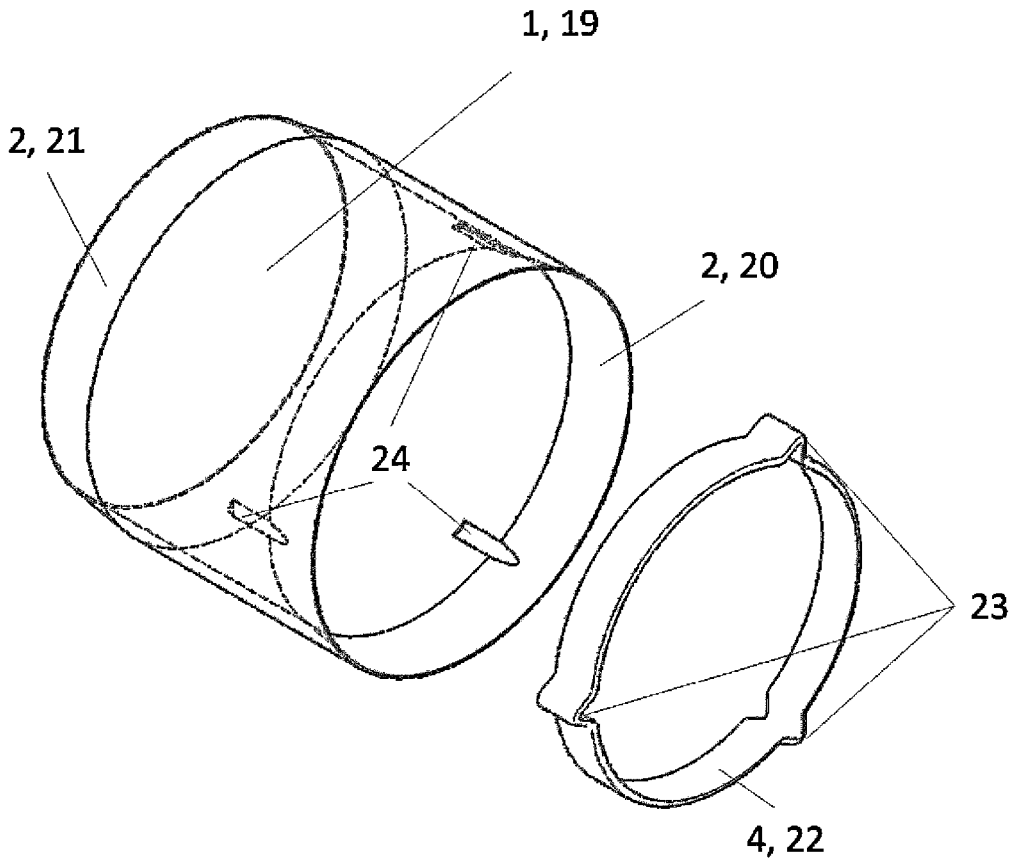
FIG. 3*a* to 3*e* show an embodiment of the pipe in multiple views and sectional views, in which the pipe shell segments are formed by short annular inner pipe portions.
Figure 3B:
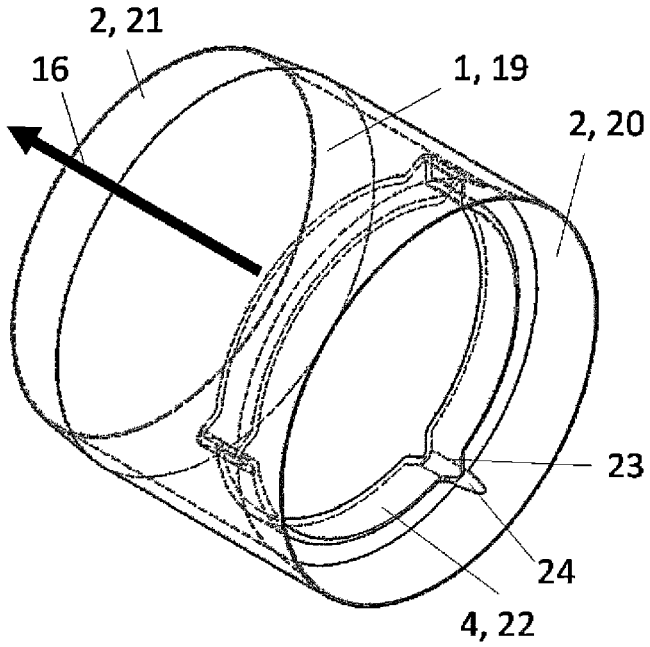
Figure 3C:
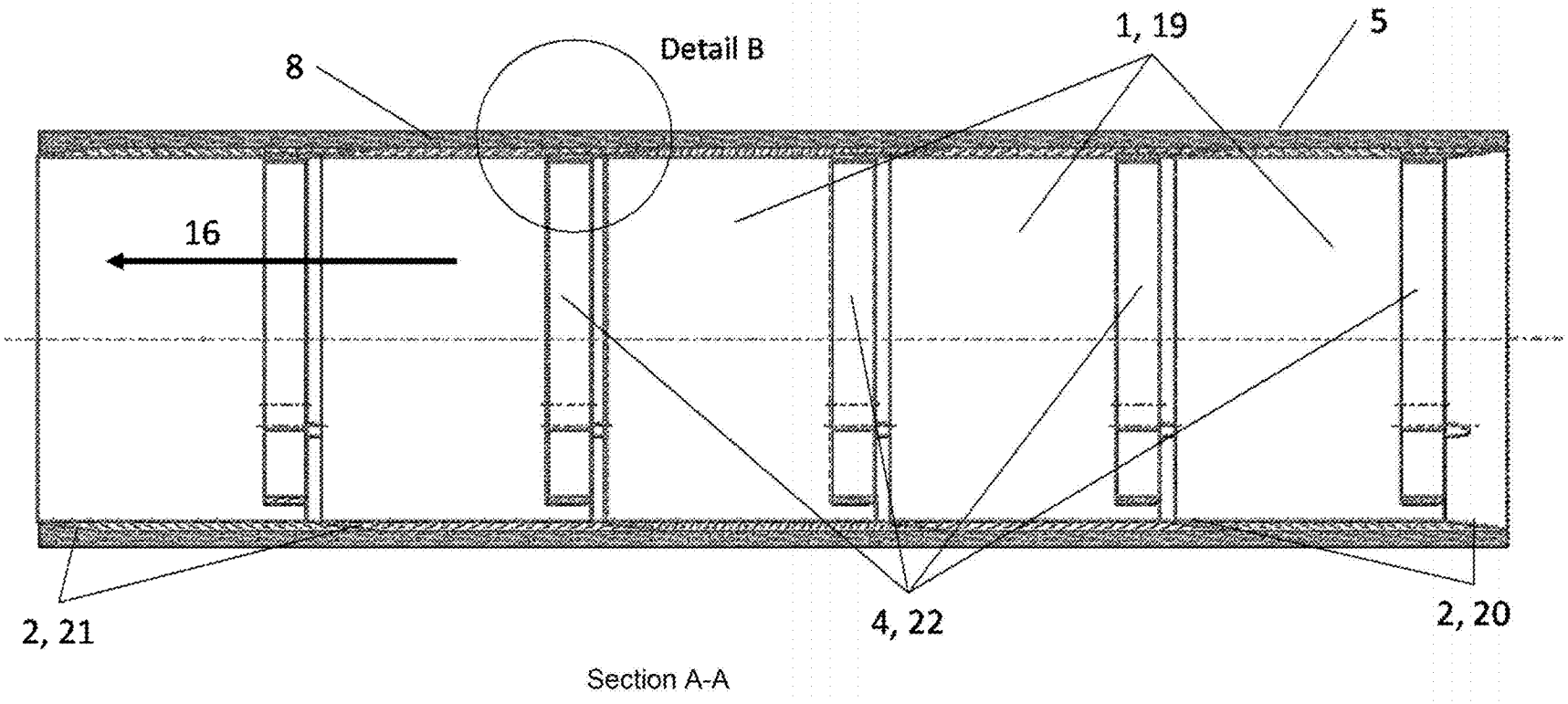
Figure 3D:
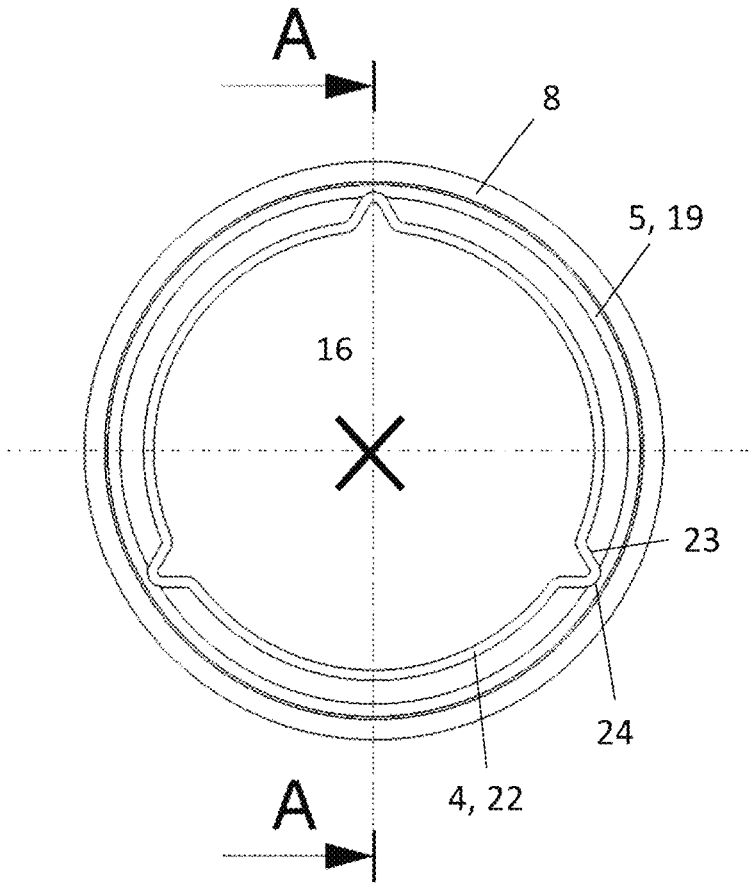
Figure 3E:
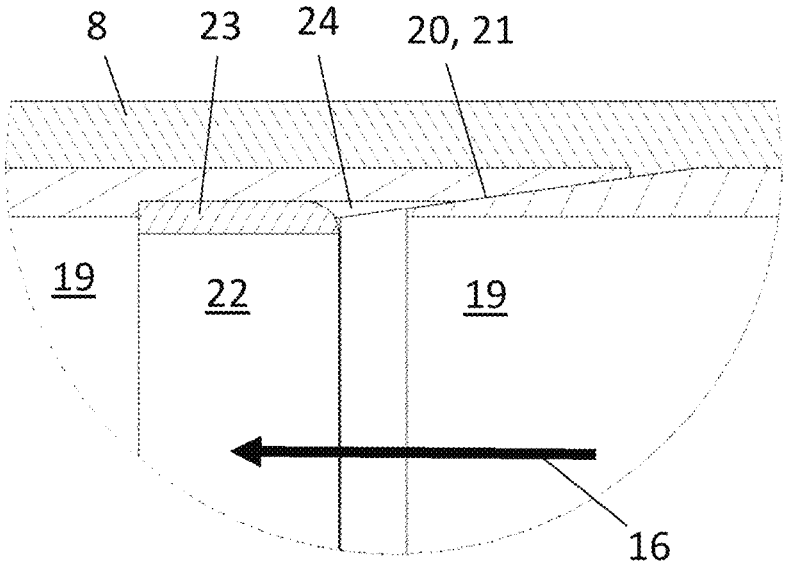

FIG. 3*a* shows a single inner pipe portion with two annular abutment surfaces 2 arranged at the ends, in each case an inner cone 20 and an outer cone 21, which, when multiple inner pipe portions are placed on one another, fit together form-fittingly to the adjacent outer or inner cone, respectively, and in each case form peripheral abutment lines (cf. FIG. 3*b* to *d*). Furthermore, an annular flow baffle plate 22 with spacer 23 is provided, which can be inserted form-fittingly into corresponding receiving grooves 24 on the inner wall of the inner pipe portion 19 (cf. FIG. 3*b* to *e*) and is secured against axial detachment from its position by a docking of an adjacent inner pipe portion (cf. FIGS. 3*c* and *e*). The inner pipe portions arranged axially in series form the inner pipe 5 in their assembled entirety. FIGS. 3*c* and *e* moreover show a coating on the inner pipe, which coating bridges one of the abutment lines 6.

Figure 4A:
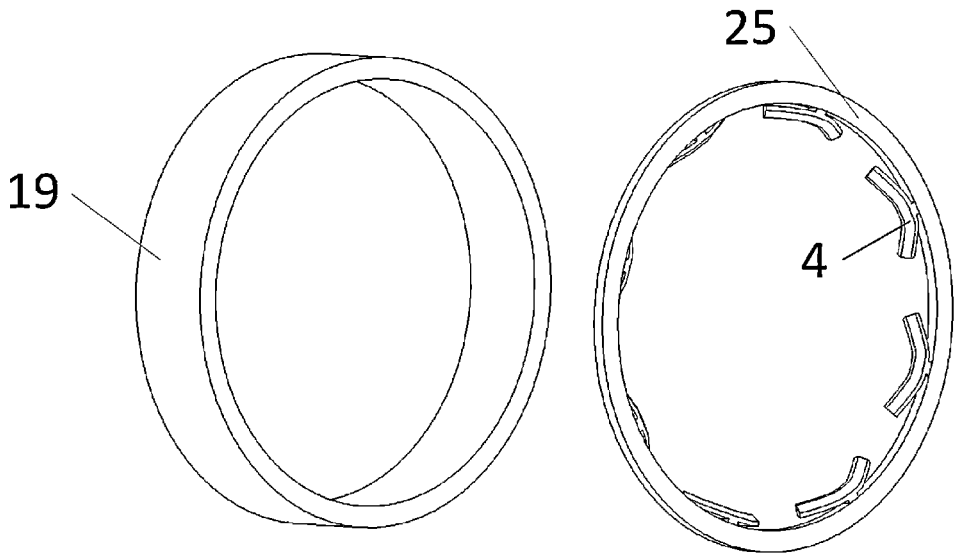
FIGS. 4*a* and 4*b* show a further embodiment of the pipe in which the pipe shell segments are formed by annular inner pipe portions.
Figure 4B:
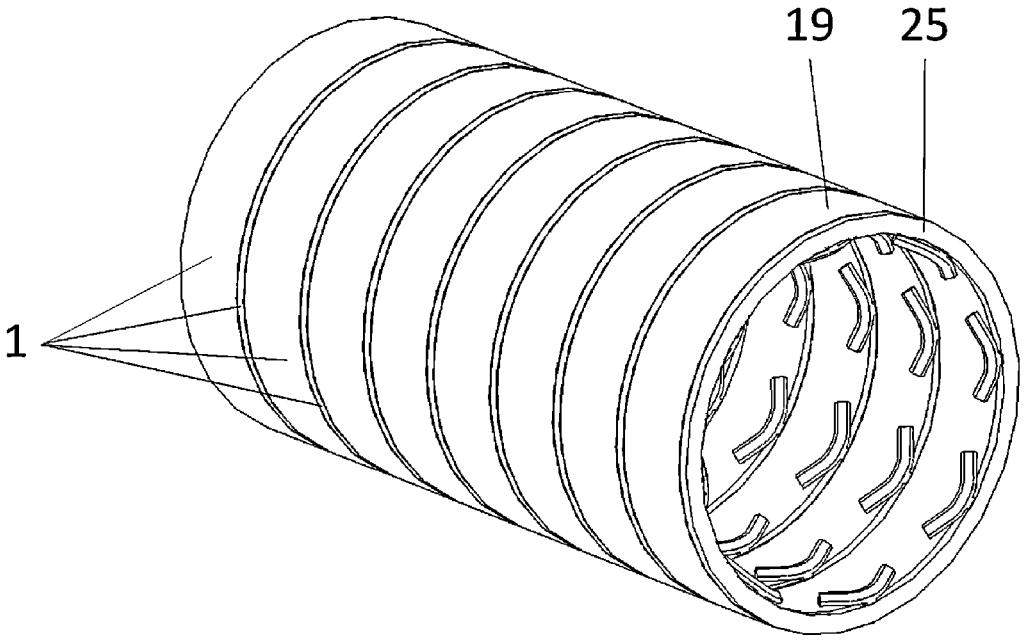

Also in FIGS. 4*a* and *b* is a further embodiment in which the pipe shell segments 1 are formed by annular inner pipe portions. Here, the sheet metal rings 25, shown in FIG. 4*a*, with inwardly integrally molded topographic sheet metal structures 4 are assembled one after the other alternately with inner pipe portions 19 to form an inner pipe (cf. FIG. 4*b*), the sheet metal rings preferably having preferably sealing and/or centering formations for receiving the adjacent inner pipe portions (pipe elements for example without inner wall structures). The pipe shell segments are thus formed by the sheet metal structures and the inner pipe portions.

The sheet metal rings are preferably cut from a sheet metal by means of beam technology (laser or EB), for example as follows:

- cutting out a planar sheet metal blank from the sheet metal
- chamfering, punching, bending or embossing of the edge on the inner side of the sheet metal blank to form the topographic structures, e.g., of 3 dimensional rib structures which project beyond the contour of the inner wall of the subsequent inner pipe at least on one side in the axial direction
- mechanical alternating connection of the aforementioned sheet metal rings in alternation with inner pipe portions without topographic structures on the inner side, threading for example on a mandrel as a fixing means and clamping of the end-side inner pipe portions against each other
- additive application of the coating consisting of a metallic material on the outer wall of the pipe shell segments over the abutment lines to form a contiguous pipe body.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1. pipe shell segments
2. abutment surface
3. detailed view
4. topographic structures
5. inner pipe
6. abutment lines
7. fixing means
8. coating
9. pipe body
10. end face
11. detailed view
12. seamless pipe
13. weld seam
14. flow baffle plates
15. groove
16. flow direction
17. cross-section
18. interlocking shaped elements
19. inner pipe portions
20. inner cone
21. outer cone
22. annular flow baffle plate
23. spacer
24. receiving grooves
25. sheet metal ring

The invention claimed is:

1. A method for producing a pipe with an inner pipe having topographic structures arranged on an inside of the inner pipe and having a coating arranged on an outside of the inner pipe, the method comprising:

a) providing at least two pipe shell segments, each with an inner wall, an outer wall, and a peripheral abutment surface, which are placeable on one another in an accurately fitting manner to form the inner pipe;

b) mounting or introducing the topographic structures on or in the inner wall of each pipe shell segment of the at least two pipe shell segments;

c) placing the pipe shell segments on one another via the abutment surfaces to form the inner pipe so as to form abutment lines;

d) fixing the pipe shell segments incorporated in the inner pipe by placing fixing means thereon; and e) additively applying a coating comprising a metallic material to an outer wall of the pipe shell segments over the abutment lines to form a contiguous pipe body.

2. The method of claim 1, wherein the fixing means are placed over regions of the outer walls of the pipe shell segments to cover the regions, and wherein the method further comprises:

f) removing the fixing means so as to expose the regions of the outer walls; and g) additively applying the metallic material in the regions of the fixing means as part of the coating.

3. The method of claim 1, further comprising:

subsequent thermal and/or mechanical post-processing of the coating and/or end faces of the inner pipe with the coating.

4. The method of claim 3, wherein the mechanical post-processing comprises an overmachining of the coating, and wherein a rotationally symmetrical coating surface arranged concentrically to the pipe is formed.

5. The method of claim 4, wherein the overmachining comprises an overturning or overgrinding.

6. The method of claim 4, further comprising:

subsequently concentrically sliding over or pressing on of a pressure-bearing structure over the coating surface.

7. The method of claim 6, wherein the pressure-bearing structure comprises a seamless pipe with an inner diameter greater than or equal to a diameter of the coating surface, and wherein the method further comprises:

h) welding the seamless pipe at the end faces with the coating surface so as to produce a closed interior volume between the seamless pipe, the coating surface, the coating, and/or the inner pipe, and i) hot isostatic pressing of the seamless pipe with the coating surface.

8. The method of claim 1, wherein the mounting or introduction of the topographic structures on or in the inner wall of the pipe shell segments is by primary forming, re-shaping, separating, joining, removal, or coating methods.

9. The method of claim 1, wherein the fixing takes place at least in each case at end regions of the inner pipe.

10. The method of claim 1, wherein the fixing means comprise clamps encircling the inner pipe, which are placed around the inner pipe for fixing the pipe shell segments integrated in the inner pipe and completely enclose the inner pipe.

11. The method of claim 1, wherein the additive application of the coating takes place on the outer wall by an application welding process, and wherein the metallic material is provided in powder or wire form and is melted by a heat source.

12. The method of claim 1, wherein the coating is applied to the outer wall by cold spraying or thermal spraying, and wherein the metallic material is provided in powder form.

13. The method of claim 1, wherein the pipe shell segments are already present pre-shaped in a form of a near-net-shape during the application or introduction of the topographic structures on or in the inner wall, and are placed against each other without further deformation to form the inner pipe with formation of abutment lines.

* * * * *